United States Patent [19]

Schön

[11] 4,124,782

[45] Nov. 7, 1978

[54] SOUND PICKUP HAVING PLASTIC ENVELOPED POLE PLATE TO POLE ROD JUNCTION

[75] Inventor: Manfred Schön, Vienna, Australia

[73] Assignee: AKG Akustische u. Kino-Gerate Gesellschaft m.b.H., Australia

[21] Appl. No.: 709,074

[22] Filed: Jul. 27, 1976

[30] Foreign Application Priority Data

Jul. 29, 1975 [AU] Australia ..... 5869/75

[51] Int. Cl.[2] ..... H04R 11/12

[52] U.S. Cl. ..... 179/100.41 K; 179/100.41 M; 179/100.41 Z

[58] Field of Search ..... 179/100.41 K, 100.41 M, 179/100.41 Z, 100.41 R

[56] References Cited

U.S. PATENT DOCUMENTS

| | | | |
|---|---|---|---|
| 3,146,319 | 8/1964 | Stanton | 179/100.41 K |
| 3,299,219 | 1/1967 | Madsen | 179/100.41 K |
| 3,349,194 | 10/1967 | Shaper | 179/100.41 Z |
| 3,441,688 | 4/1969 | Shaper | 179/100.41 K |
| 3,576,956 | 5/1971 | Lanooy et al. | 179/100.41 K |
| 3,683,128 | 8/1972 | Grado | 179/100.41 K |

*Primary Examiner*—Raymond F. Cardillo, Jr.
*Attorney, Agent, or Firm*—McGlew and Tuttle

[57] ABSTRACT

An electromagnetic or magnetodynamic transducer-sound pickup comprises a phonograph needle which is connected to either a permanent magnet or a soft iron magnetic member and which is mounted for oscillation in front of, or between a plurality of parallel spaced apart pole rods which are provided with energizing coils. The pole rods are connected at one end to a pole plate. Mechanical oscillations of the magnetic system are suppressed in the zone where the pole plate is connected to the pole rods or in the zone where the pole plate is connected to the permanent magnet by an envelope of plastic which is injection molded around the plate and the rods.

4 Claims, 3 Drawing Figures

SOUND PICKUP HAVING PLASTIC ENVELOPED POLE PLATE TO POLE ROD JUNCTION

BACKGROUND OF THE INVENTION

1. FIELD OF THE INVENTION

This invention relates in general to the construction of sound pickups and in particular to a new and useful sound pickup which operates on the principle of a magnetodynamic or electromagnetic transducer and in which a permanent magnet or a soft iron part, connected to a phonograph needle, is mounted for oscillation in front of or between parallel pole rods which are provided with coils and which are connected at one of their ends to a common pole plate.

2. DESCRIPTION OF THE PRIOR ART

The mechanical oscillations which are picked up by a needle of a sound pickup are converted into a corresponding audio frequency alternating voltage by a variation of the flux in a magnetic circuit. The lines of force of the magnetic flux penetrate coils provided on pole rods in the sound pickup. In magnetodynamic systems, the magnetic flux is produced by a permanent magnet which is mounted in front of or between the free ends of the pole rods and which is moved by the needle. In electromagnetic systems the permanent magnet producing the flux is firmly connected to the pole plate carrying the pole rods and the variations of the flux are produced by a soft iron armature which is mounted for oscillation in front of the free ends of the pole rods and moved by the phonograph needle. In these prior art constructions, which are of uniform design, an undesired effect is produced in that, because of the influence of the acting magnetic forces, the pole rods tend to oscillate during operation and such oscillation produces mechanical vibrations which lie in the acoustic range and unfavorably affect the transmission response of the pickup. In particular, peaks and troughs appear in the characteristic of the transducer. Even with a suitable dimensioning of the pole rods and coils it is difficult to reduce the vibrations.

Another known provision for reducing the tendency to oscillations is an embedding of the entire magnetic system in a plastic. Such constructions however have the disadvantage of great weight, which is undesirable with pickups.

SUMMARY OF THE INVENTION

The present invention provides a pickup design which makes it possible to avoid disturbing resonances particularly of the pole rods of the magnetic system, without substantially increasing the weight of the system and without resort to special dimensions or shapes of the pole rods and coils.

In accordance with the invention the undesirable mechanical oscillations of the parts of the magnetic system are prevented by providing an envelope of plastic in the zone where the pole plate is connected to the pole rods or to a permanent magnet. The envelope is formed by injection molding and the pole plate and portions of the pole rods are embedded therein. By this inventive measure a particular acoustic effect is obtained due to the damping of the natural resonances of the pole rods. In addition a manufacturing advantage is obtained because the construction may be manufactured with high accuracy and reliable reproducibility. Further because of the excellent mechanical damping characteristics the geometry of the pole rods and coils of the inventive construction may optionally be varied within very large limits.

Accordingly it is an object of the invention to provide an apparatus for suppressing mechanical oscillations in a magnetic system which includes an envelope of injection molded plastic connected to at least the pole plate or the pole rod at the location of their interconnection or at a location where the pole plate is connected to the magnetic member.

A further object of the invention is to provide a pickup which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there are illustrated preferred embodiments of the invention.

GENERAL DESCRIPTION OF THE PREFERRED EMBODIMENTS

Figure 1:
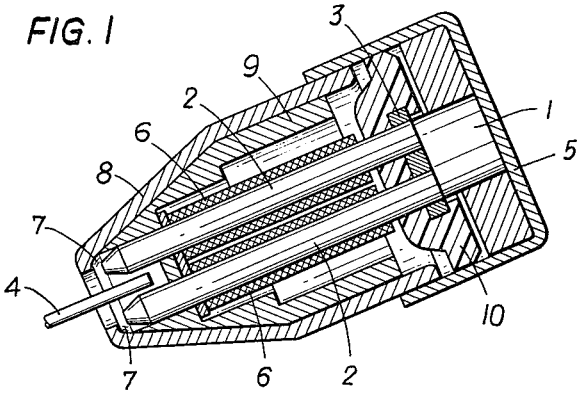
FIG. 1 is a partially diagrammatical sectional view of an electromagnetic pickup constructed in accordance with the invention.
Figure 2:
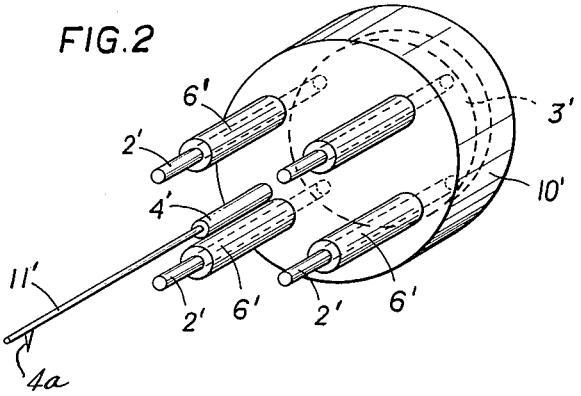
FIG. 2 is a perspective view of another embodiment of the invention.

Referring to the drawings in particular the invention embodied therein in FIG. 1 comprises a magnetic member 4 which may be a soft iron tube which is connected to a needle **4*a* as in the embodiment of FIG. 2 but which is not shown in FIG. 1. The inner end of the tube 4 is positioned close to the free ends of a plurality of pole rods 2 which in the embodiment shown includes four pole rods arranged in a square configuration. The pole rods 2 have inner ends which are connected to a common pole plate 3**.

In accordance with the invention an envelope 10 of injection molded plastic covers the inner ends of the pole rods 2 and the pole plate 3 so that these become embedded within the plastic. The plastic envelope 10 may be designed in accordance with the invention so that a permanent magnet 1 applying against pole plate 3 is completely or partly embedded in the envelope 10. The magnetic flux starting from the permanent magnet 1 penetrates a surrounding jacket or pot 5 of the magnet and an outer jacket 8. The flux also extends in the gap between the jacket 8 and the pole rods 2 and returns to the permanent magnet 1 through the pole rods 2 and the pole plate 3. The pole rods 2 each carry a coil 6 which along with the pole rods 2 are received in a housing or casing 9. The phonograph needle **4*a* positively transmits movements to the soft iron tube or magnetic member 4 which is located between the free ends of the pole rods 2 so that the magnetic flux is varied and consequently the corresponding voltages (emf) are induced in the coils 6**.

In the embodiment shown in FIG. 2 similar parts are similarly designated but with primes added thereto. In this construction the magnetic member 4' does not comprise a soft iron tube but a cylindrical permanent magnet. In this construction the lines of force of the magnetic system are also closed through the pole rods 2' and the pole plate 3'. The magnetic member 4' carries a needle holder 11 which carries a needle 4a which may for example be a diamond stylus.

Figure 3:
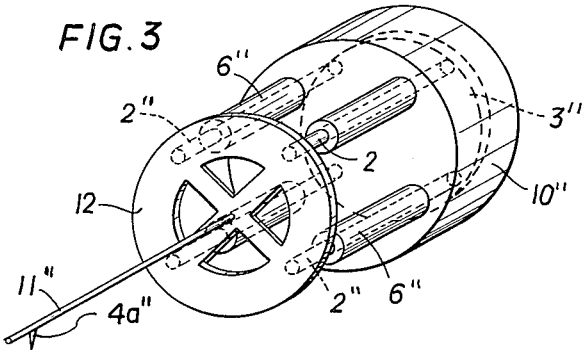
FIG. 3 is a perspective view of still another embodiment of the invention.

In the embodiment shown in FIG. 3 similar parts are designated with double primes. In this construction instead of a soft iron tube 4 as in the embodiment of FIG. 1 there is a magnetic member in the form of a soft iron armature 12 which has an annular configuration and is positioned in front of the free ends of the pole rods 2''. In respect to the remaining portions the construction is identical with that shown in FIG. 1.

Due to the inventive arrangement the pole rods and the pole plate are connected and fixed by embedding the whole juncture in a plastic envelope 10. This provides an effective mechanical damping of the pole rods and provides a pickup which has a surprisingly smooth characteristic and is free from peaks and troughs.

In accordance with the method of manufacture of the invention the four pole rods 2, the pole plate 3 and if provided the permanent magnet 1 are placed in a die mold and plastic is injected so that the assembly becomes firmly affixed adhered together and an extremely close contact of all parts is obtained. The injection molded thermoplastic is then firmly adhered to all surfaces of the junction. In this manner the best condition for damping the oscillations of the pole rods is effected. By selecting a plastic having a high internal friction and using a corresponding injection pressure a damping factor can be obtained resulting in a total absence of peaks and troughs in the characteristic of the pickup.

While specific embodiments of the invention have been shown in described in detail to illustrate the application of the principles of the invention, it will be understood that the invention may be embodied otherwise without departing from such principles.

What is claimed is:

1. An electromagnetic and magnetodynamic-transducer-sound pickup, comprising a plurality of substantially spaced apart pole rods, a coil associated with each of said rods, a common pole plate connected to the ends of said rods, a phonograph needle, a magnetic member connected to said phonograph needle and being oscillatable thereby and being disposed adjacent said rods, and an envelope of injection molded thermoplastic firmly adhering to said pole rods and said pole plate at the junctures thereof and embedding said pole rods and said pole plate within the thermoplastic, said envelope being injection molded only substantially in the immediate vicinity of said junctures and firmly adhered to said junctures after said pole rods and said plate are in place whereby the natural resonance of said pole rods is dampened to smooth the frequency characteristic of the pickup.

2. A sound pickup according to claim 1, wherein said magnetic member comprises a soft iron tube connected to a needle and having an inner end mounted adjacent the outer ends of said pole rods, and a permanent magnet secured to said pole plate, said plastic envelope enclosing a portion of said permanent magnet with said pole plate and said rods.

3. A sound pickup according to claim 1, wherein said magnetic member comprises a tubular permanent magnet, a needle holder extending in said permanent magnet and having said needle at the end thereof.

4. A sound pickup according to claim 1, wherein said magnetic member comprises a soft iron annular armature disposed adjacent the outer ends of said pole rods and a needle holder connected to said armature.

* * * * *

UNITED STATES PATENT AND TRADEMARK OFFICE

CERTIFICATE OF CORRECTION

PATENT NO. : 4,124,782

DATED : November 7, 1978

INVENTOR(S) : Manfred Schon

It is certified that error appears in the above-identified patent and that said Letters Patent are hereby corrected as shown below:

On the cover sheet Item (75), Item (73) and Item (30), "Australia" each occurrence should read -- Austria --.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*